United States Patent [19]

Barber et al.

[11] Patent Number: 4,749,121

[45] Date of Patent: Jun. 7, 1988

[54] REINFORCED FILE FOLDER

[75] Inventors: Donald T. Barber, Toronto; Erhard P. Walter, Bramalea, both of Canada

[73] Assignee: Datafile Limited, Willowdale, Canada

[21] Appl. No.: 793,173

[22] Filed: Oct. 28, 1985

Related U.S. Application Data

[60] Division of Ser. No. 569,576, Jan. 10, 1984, Pat. No. 4,588,463, which is a continuation-in-part of Ser. No. 439,280, Nov. 4, 1982, abandoned.

[51] Int. Cl.[4] ..... B65D 27/00

[52] U.S. Cl. ..... 229/1.5 R; 40/359

[58] Field of Search ..... 229/1.5 R; 40/359, 360; 428/122, 124

[56] References Cited

U.S. PATENT DOCUMENTS

| | | | |
|---|---|---|---|
| 1,150,034 | 8/1915 | Hub | 40/360 |
| 1,273,960 | 7/1918 | Wagemaker | 40/360 |
| 1,743,191 | 1/1930 | Charlton | 40/359 |
| 1,757,122 | 5/1930 | Hunter | 40/360 |
| 1,868,188 | 7/1932 | Barker | 40/360 |
| 2,052,623 | 9/1936 | Harby | 40/359 |
| 2,062,436 | 12/1936 | Yawman | 40/359 |
| 2,264,295 | 12/1941 | Carter | 428/122 |
| 2,961,365 | 11/1960 | Sroog | 206/813 |
| 3,937,493 | 2/1976 | Fasbender | 40/359 |
| 4,175,476 | 11/1979 | Kidd . | |
| 4,284,227 | 8/1981 | Corey | 229/1.5 R |
| 4,580,815 | 4/1986 | Barber | 40/360 |

FOREIGN PATENT DOCUMENTS

| | | |
|---|---|---|
| 8201165 | 4/1982 | PCT Int'l Appl. . |
| 1123130 | 8/1968 | United Kingdom . |

*Primary Examiner*—Stephen P. Garbe

[57] ABSTRACT

A file substrate of paper stock such as a file backer or file folder having a reinforced edge portion is disclosed. Such file substrate has at least one straight edge with a tear resistant plastic film secured either side of the substrate and about the straight edge. This film reinforces the substrate straight edge without significantly increasing the thickness thereof. A colored adhesive may be used for securing a clear reinforcing film to the folder. This provides a color band down a side of the folder to distinguish a group of files in a file system. Method and apparatus are disclosed for applying the reinforcing film to file folder blanks.

13 Claims, 10 Drawing Sheets

REINFORCED FILE FOLDER

This is a division, of application Ser. No. 06/569,576 filed Jan. 10, 1984, now U.S. Pat. No. 4,588,463 a continuation of application Ser. No. 06/439,280 filed Nov. 4, 1982 now abandoned.

FIELD OF THE INVENTION

This invention relates to file folders, file backers and the like used in filing systems and more particularly to such folders, backers and the like having at least one reinforced edge for use in such systems.

BACKGROUND OF THE INVENTION

With the ever increasing use and popularity of colour coded filing systems in offices there is a decided trend to the use of side tab folders. Side tab folders should be distinguished from top tab folders. Top tab folders are indexed on the upper edge parallel to the spine or fold between the front and back surfaces of the folder. Side tab folders are indexed on the side at right angles to the spine or fold. The file folders are placed upright on shelves with their side edges projecting outwardly from the shelf. Side tab filing systems have become most advantageous, especially in larger filing systems, because the filing and finding of folders is faster and easier. Also, side tab filing systems save floor space as compared with drawer filing. The colour coding of the files is not a necessity but can usually be an enhancement. The reinforced edge can advantageously be used in either top or lateral systems.

An example of side tab file systems is disclosed in U.S. Pat. No. 4,204,639. Usually file folders remain in a filing system for many years and during the life of the folder are subjected to considerable wear and tear and often to severe handling and abuse. Also, as they are moved between the file room to the user departments they are often roughly handled as they are temporarily placed in holding baskets or carts with the side tab projecting. This projecting tab is exposed and thus vulnerable to creasing, tearing and fatigue.

The folder stock commonly used for file folders, backers and the like is a folder stock approximately 0.011 inches or 0.014 inches thick. The folders are manufactured from web stock on high speed automatic folder machines.

In the past, many attempts have been made to reinforce file folder edges, especially the top tab type which have been commonly used for many years and are stored in file drawers. Usually the upper edge of the file folder is reinforced in one way or another to withstand abuse. An example of such file folder reinforcement is disclosed in U.S. Pat. No. 1,743,191. In that instance, the upper edge of the rear panel of the folder has an additional layer of file folder stock glued to the upper edge and wrapped aroung the upper edge of the folder to provide a three ply thickness to substantially reinforce the upper edge. Other examples of similar manners for reinforcing file folder edges, are disclosed in U.S. Pat. Nos. 1,081,727; 2,052,623 and 2,138,788. In each instance, either the file folder stock integral with the folder is folded over and glued to reinforce the edge or additional material is added of the same file folder stock to reinforce the edge.

The approach to date has, therefore, been to add additional layers of the folder stock to the folder edge in an attempt to reinforce and add stiffness to the folder edge to resist tearing.

Various forms of high tensile strength films have been used to repair rips in paper and protect surfaces of paper products. An example of such film is Mylar (trademark) which consists of polyethylene terephthalate and is sold by Du Pont. In the file folder field, such film is used to protect add-on file folder tabs as disclosed in copending U.S. patent Ser. No. 276,939 which corresponds to Canadian Patent application Ser. No. 380,208 filed June 19, 1981.

It has been discovered as discussed below that this type of high tensile strength film may be bonded to the edge of a file folder to unexpectedly greater increase the strength of the folder and its resistance to tear. Because of the thinness of the film, little bulk is added to the folder thickness and the film may be conveniently applied during the manufacture of the file folder. By using coloured adhesives, which may be applied to a clear film just prior to bonding the film to the folder edge, the edge of the folder front and back panels may be provided with a distinct colour to which colour coded labels may be subsequently applied. An alternative to a coloured adhesive is to use a coloured paper on the folder edge which is covered by a clear film. Another alternative is to use coloured film which is secured to the folder edge to provide the desired colour band. This is a significant advantage in that groups of files of a file system may now be recognized by the complete band of colour down its front and back panel edges. This avoids the prior more costly approach of using many different coloured folder stocks for distinguishing each desired group of files in the system. Such coloured paper stock would fade and loose its distinctive colour. In addition, the colour of the folder stock would change from batch to batch of the stock, so that there would not be a consistent colouring for a group of files.

The folders can be manufactured from web stock on high speed automatic folder machines where the high tensile strength film when bonded to the edge of a file folder unexpectedly greatly increases the strength of the folder and its resistance to tear. This advantage can be accomplished during the folder manufacturing process in a way that only marginally increases the manufacturing cost. This marginal cost factor in relation to a much superior file folder is a worthwhile and important advantage. Such high tensile strength film compliments and increases additionally the strength of a folder edge which consists of ploughed over web stock to provide a double thickness of paper stock at the edge. Also, the high tensile strength film provides a superior bonding surface for the attachment of the self adhesive indexing and colour coded labels used to identify the folders.

SUMMARY OF THE INVENTION

The folder, according to this invention, has its side portion reinforced by the use of a high tensile strength tear resistant reinforcing film. According to an aspect of the invention the film is used to reinforce side tabs for folders which are used in a lateral file system. Such folders comprise a rectangular blank which when folded forms the folder. A side of the blank includes a projection to provide the side tab where the folder side has an undercut portion adjacent the projection. The blank in the area of the undercut is reinforced by securing to both surfaces of the blank, a high tensile strength tear resistant reinforcing film. Such film minimizes tearing of the folder in the area of the undercut during use of the folder in a lateral file system.

The folder may be formed from web stock which is drawn from a supply roll. The edge may be optionally ploughed over and secured to provide a double thickness of paper stock at the folder edge. The film is adhered by an appropriate adhesive to a side edge of the web stock and is wrapped around the edge and secured to both surfaces. The film can also be applied to one surface of the paper web stock adjacent the edge thereof and both the film and web stock are rolled or ploughed over such that the film is to the outside. The edge of the folder can then be die cut to provide the desired shape for the side of the folder and at the same time or at another station the web stock is due cut to produce a folder blank which is then folded about its mid-section to provide a file folder.

The method for reinforcing side edge portions of the front and back panels of the folder comprises securing a width of reinforcing tear resistant plastic film along an edge of the paper material for the folder. The film is secured to the paper material by an adhesive with the film wrapped about the edge and along portions of both surfaces of the material adjacent the edge. The paper material can be cut along the edge within the width of the film to provide the desired shape for the folder edge with a tab projecting from the back panel. The film, as it extends along both edge surface portions reinforces the projecting tab and a portion of the panels adjacent the tab. This serves to reinforce both the tab and the junction of the tab and the panel. Various coloured adhesives may be used with clear film, or a coloured film may be used to provide desired colour bands along the folder side to designate groups in a file system. The band width colour on the exterior of the front folder flap may be wider than on the exterior of the folder so that the colour designation is more noticeable when the folder lies upright on a desk.

An apparatus is provided for applying a desired coloured adhesive to the film, drying the adhesive on the film and applying it to the folder paper stock. The apparatus includes an interchangeable reservoir to permit selective changing of the coloured adhesive and thereby the colour band on the folder in preparing groups of folders of the system.

BRIEF DESCRIPTION OF THE DRAWINGS

Preferred embodiments of the invention are shown in the drawings wherein.

DETAILED DESCRIPTION OF THE PREFERRED EMBODIMENTS

The file folders as reinforced in accordance with this invention optionally having colour banding applied thereto are particularly useful in lateral filing systems. Such filing systems differ from the standard drawer type in that the file folders are placed on shelves and stand upright as they rest on the spine portion of each file. Only the side edges of the file folder project from the shelf where each folder side edge carries labels or a label defining the code for the file. It is possible to use colour coded labels with this system to provide an orderly colour array in which misfiles are easily spotted. Details of this system are disclosed in previously mentioned U.S. Pat. No. 4,204,639.

Figure 1:
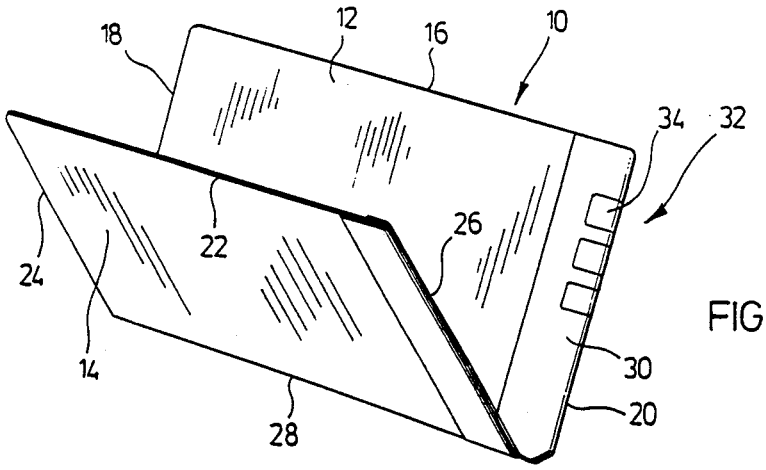
FIG. 1 is a perspective view of a file folder having a side portion reinforced in accordance with this invention.

Referring to FIG. 1, a file folder 10 for use in a lateral file system is shown. File folder 10 comprises a back panel 12 and a front panel 14. The back panel 12 has a top edge 16 and side edges 18 and 20. Similarly, the front panel has top edge 22 and side edges 24 and 26. The bottom edges of front and back panels are interconnected at the fold or spine portion 28. A reinforcing film 30 is applied to both the top and bottom surfaces of panel edges 20 and 26 in the manner shown, to reinforce the folder side generally designated 32 along the length of edges 20 and 26. Reinforcement of edge 32 includes reinforcing the projecting tab to decrease damage by creasing or folding causing weakening and separation of the layers making up the web stock as well as reinforcing of the area securing the tab to the panel. This second type of reinforcing is accomplished by having a portion of the film overlie the paper web panels to distribute the local forces exerted on the tab to a larger area of the file folder. In addition, labels 34 are applied over the film 30 to designate at least in part a code for the file folder. In accordance with the aforementioned U.S. Pat. No. 4,204,639, these labels may be colour coded.

Figure 2:
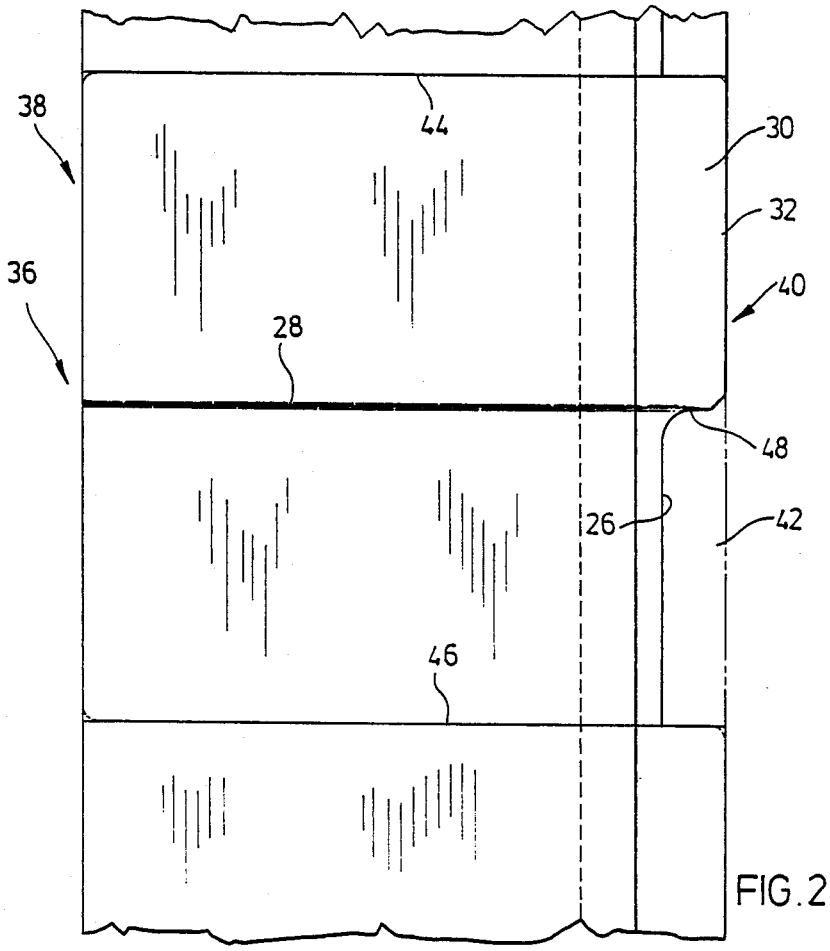
FIG. 2 is a plan view of web stock which has an edge thereof reinforced with film and from which folder blanks are die cut.

The file folder 10 is formed from a file folder blank which in turn is cut from a web of file folder stock. As shown in FIG. 2, the file folder stock 36 is a web having side edges 38 and 40. The web stock 36 has a reinforcing film 30 applied along side edge 40. The film 30 is wrapped around web edge 40 and secured to each surface, that is top and bottom surfaces, of the web stock.

Various configurations may be used in providing a folder side for use in a lateral file system. As per the arrangement shown in FIG. 1, folder side 32 is formed by cutting web side 40 within the width of film 30 along edge 26 to provide a cut-out portion 42. Depending upon the type of cutting mechanism used, the folder blank 36 is cut from the web along lines 44 and 46 either simultaneously with cutting sides 40 or cut subsequently at another station. Such cut-out blank is subsequently folded along line 28 to form the folder of FIG. 1. With portion 42 cut from the web to define the side tab 32 of the folder, an undercut portion 48 is provided at the fold line 28. It is this portion of the folder side which is most susceptible to wear and tear and can be ripped as the folder is used in lateral file systems, carrying baskets, carts and the like.

Figure 3:
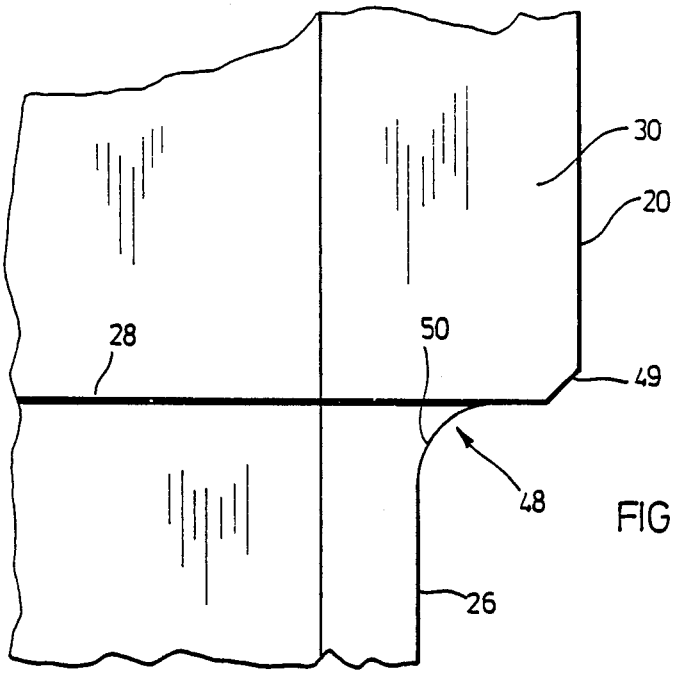
FIG. 3 is an enlarged view of the undercut portion of the side tab as it projects from the rear panel of the file folder.

Turning to FIG. 3, the undercut portion 48 is curved at 50 to reduce sharp edges which are more likely to tear. That in conjunction with the reinforcing film 30 considerably strengthens the undercut portion 48 to minimize tearing of the folder in this area. In addition the outer edge of the undercut area is sloped at 49 to avoid fraying and splitting of this protion of the side tab. From the standpoint of cutting the outer edge, the sloped portion 49 is more accurately cut than a radius because the die cutting edge may extend well beyond the folder edge. This ensures a clean cut to the outer edge of the folder side even if the web should shift slightly laterally before being cut.

Figure 4:
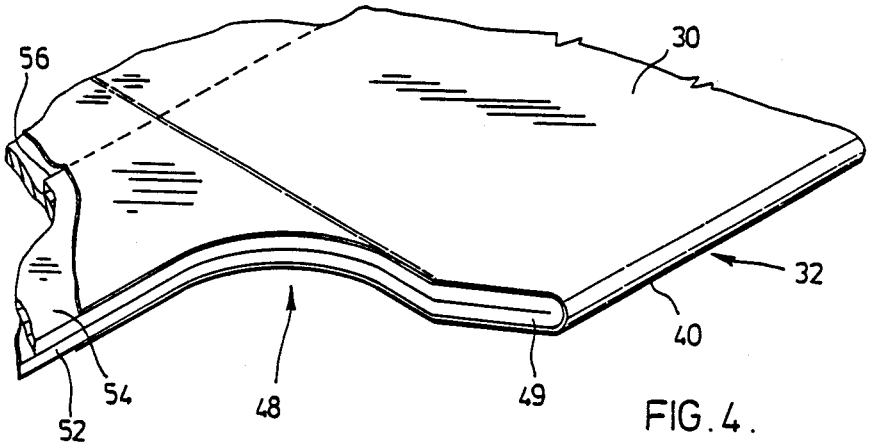
FIG. 4 is a perspective view of the enlarged portion of the undercut as shown in FIG. 3.

In the enlarged view shown in FIG. 4 the web stock material may have a side edge folded over to provide double thickness of material along the edge. The web stock edge therefore has an underlying layer 52 which has adhesively secured thereto a folded over upper layer 54 which has an inner edge 56. The reinforcing film 30 is secured to the surfaces along the side edge 40 of the web. The reinforcing film 30 is wrapped around the edge where the film is of a sufficient width to extend beyond the inner edge 56 of the folded over web stock material. Thus, the side tab portion 32 of the folder to be made has the reinforcing web wrapped therearound. In the area of the undercut 48 and outer edge 49, the film has been cut so as to be flush with corresponding cut web portions 52 and 54. It has been found that by adhesively securing the film to these portions of the folder stock and cut flush with the undercut edges, the likelihood of ripping the folder in this undercut area and along the remainder of the folder side is minimized due to the significant increase in strength of the folder side by way of the reinforcing film.

Figure 5:
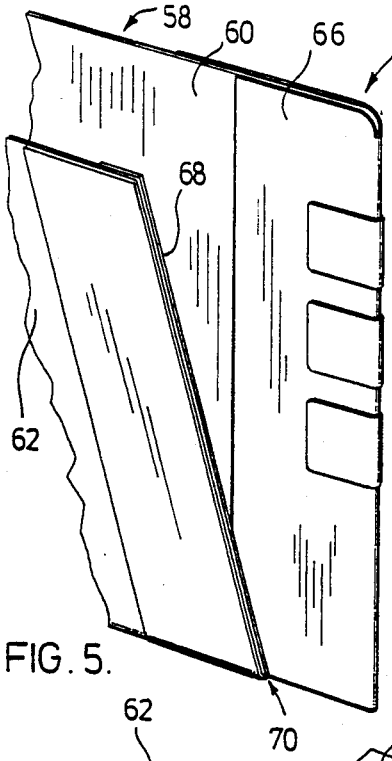
FIGS. 5 and 6 show other arrangements for file folder side tab portions as reinforced in accordance with this invention.
Figure 6:
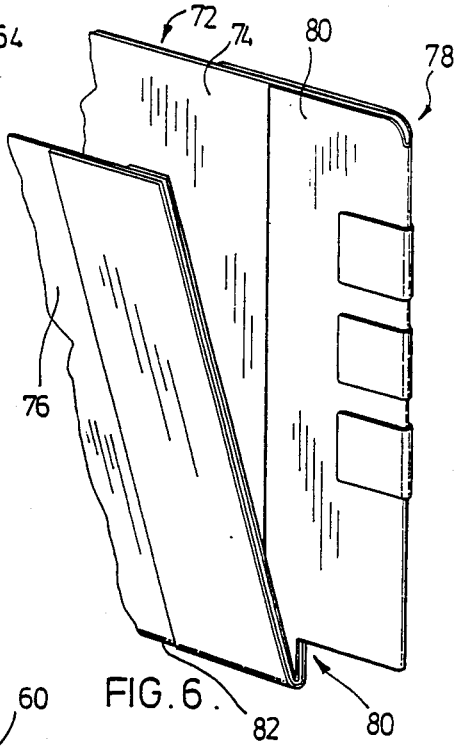
Figure 7:
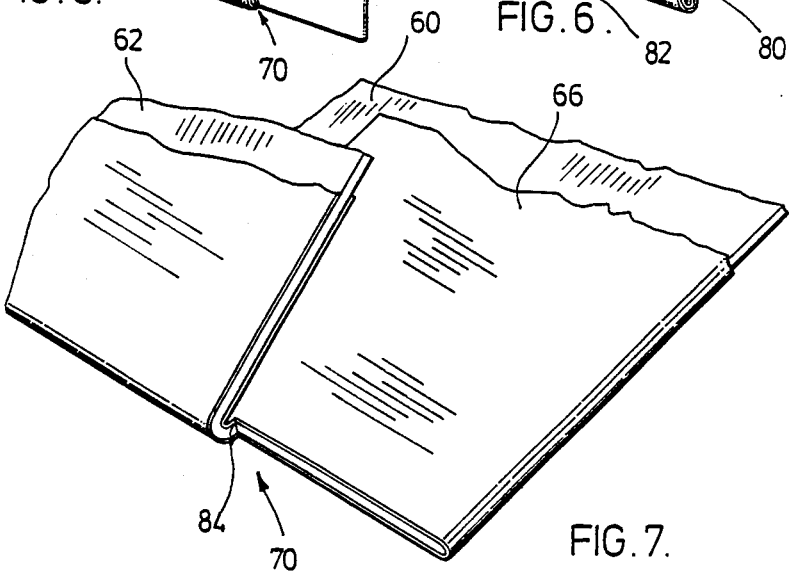
FIG. 7 is an enlarged view of the undercut portion of the file folder side tab arrangement of FIG. 5.

Referring to FIGS. 5, 6 and 7, alternative arrangements for file folder side portions for use in lateral file systems are shown. In FIG. 5, side region 58 of a file folder comprises rear panel 60 and front panel 62. Projecting outwardly from rear panel 60 is side tab 64. A reinforcing film 66 is applied to both surfaces of the side tab 64 and also along both surfaces of the edge 68 of front panel 62. The reinforcing film 66 reinforces the entire side of the folder 58, particularly the area of undercut at 70 where the shorter front panel 62 intersects the longer rear panel 60. As shown in FIG. 6, file folder portion 72 has corresponding rear panel 74 and front panel 76 with side tab 78. Film 80 is secured to both surfaces of the front and back panels to reinforce the panel side and particularly the undercut portion 80. In the embodiment of FIG. 6 the undercut portion is located upwardly from the fold line or spine 82 of the folder.

Referring to FIG. 7 an enlarged portion of the undercut area 70 of the folder 58 of FIG. 5 is shown where the film 66 is secured by an appropriate adhesive to both surfaces of the front and back panels 60 and 62. In the area of the undercut 70, the notch 84 is protected by the film 66 secured to both surfaces surrounding the notch 84 to prevent or minimize tearing of the folder side in this area.

Figure 8:
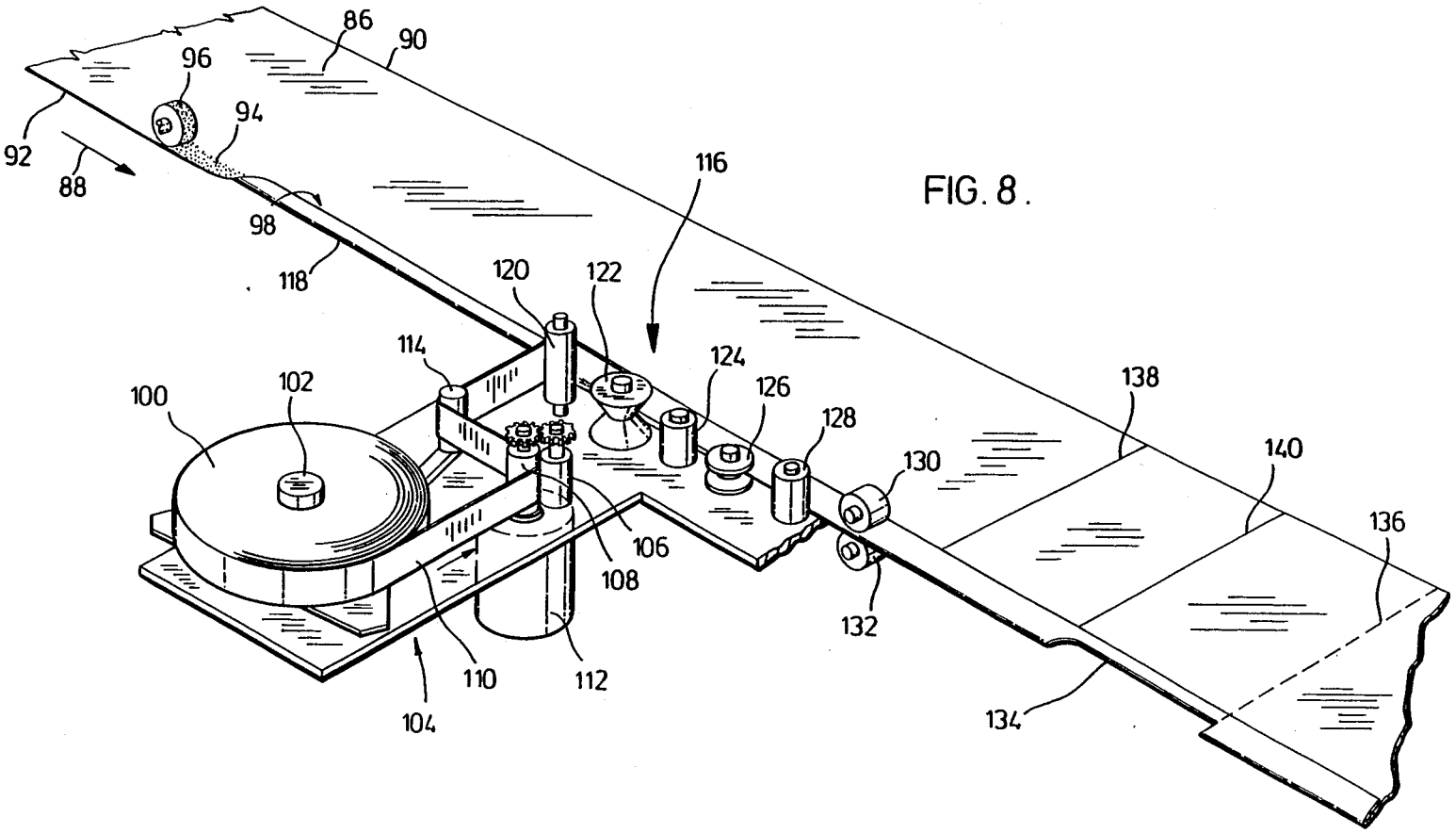
FIG. 8 is a perspective view of apparatus for applying reinforcing film to the side edge of a moving web from which the folder blanks are die cut.

Various techniques may be employed for securing and applying the reinforcing film to the edge portion of a file folder. The film itself may be provided in the form of a roll already having an adhesive on one face thereof, or the film may have applied thereto the adhesive with the film subsequently directly applied to folder web stock material. The desirable forms of adhesives are the pressure sensitive type where, if the adhesive is applied to the film and re-rolled the adhesive has less affinity for the film to which it is applied than for the paper stock material to which it is subsequently applied. Referring to FIG. 8, a machine is shown which withdraws film having already applied thereto a pressure sensitive adhesive to securing the reinforcing film to the paper stock material. The film is of a high tensile strength tear resistant type. An example of such film is polyethylene terephthalate which is sold by Dupont under the trademark "Mylar".

The web stock 86 is withdrawn from a supply roll, not shown, and fed in the direction of arrow 88. The web stock has side edge portions 90 and 92. On side edge portion 92, an adhesive 94 is applied by adhesive application wheel 96. The web stock edge 92 is folded over in the direction of arrow 98 and adhered to itself by a device not shown to provide a double edged portion along the web stock 86. This will in turn form the side edge of a folder of the type shown in the enlarged view of FIG. 4.

A supply roll 100 of reinforcing tear resistant plastic film having a pressure sensitive adhesive already thereon is mounted on a spindle 102 of the film application apparatus 104. Nip rollers 106 and 108 withdraw the film 110 from the supply roll 100. The rollers 106 and 108 are driven by a motor 112 the speed of which is coordinated with the rate of feed of the web stock 86 in the direction of arrow 88 to withdraw and feed the film 110 at a linear speed equal to the speed at which the web stock 86 is travelling in the direction of arrow 88. The film 110 is passed over a spring loaded arm having a roller 114 to compensate for slack in the film due to variations in the speed of the web stock 86 should the motor 112 not be capable of quickly compensating for variations in speed of the web stock 86.

The film is then passed over a series of standard rollers generally designated 116 which are usually used to fold the film over edge 118 of the web stock and apply it to both surfaces along the edge. The roller system 116 comprises a first vertical planar roller 120 which presses the film against the edge 118 of the moving web stock 86. Although not shown, a spring loaded device or a moveable guide is placed on the other side of the web to constantly urge the web against the roller system 16. The film 110 is gradually creased at the edge 118 of the web stock 86 by grooved roller 122. Planar vertical roller 124 maintains the slightly creased film against the edge of the web stock where roller 126 having an accentuated grooved portion creases the film further to essentially overlie both surfaces of the web stock along the edge 118. Vertical roller 128 maintains the film in this position as opposing compression rollers 130 and 132 press the film with pressure sensitive adhesive against the web stock material. With the film now adhered to both surfaces along the side edge of the web stock it is ready for cutting to form the desired side tab shape. As the web stock continues to move, a standard device (not shown) is used to cut out from the web stock, edge portion 134 which resembles the shape of cut out 42 as shown in FIG. 2 in forming the side tab arrangement for the file folder of FIG. 1. The file folder blank is cut from the web stock along lines 136 and 138 and folded about its mid section along fold 140 to form the folder of FIG. 1.

In situations where it is desired as aforementioned to provide a colour band along the side tab of the file folder, the machine and method according to this invention does this including changing the colour applied to folders with minimal difficulty. This may be accomplished by selecting a coloured adhesive which is applied to a clear reinforcing film and which is in turn applied to the file folder. As already mentioned, however, one may instead of using various coloured adhesives to determine the colour of the band along the folder side, use a reinforcing film which is itself of the desired colour. Such coloured film may then have clear adhesive applied thereto by the machine and method according to this invention, or have adhesive previously applied and re-rolled. In the latter instance with the coloured film having the adhesive already thereon, such as that shown in FIG. 8.

The width of the film applied to the web stock edge or the folder side may vary depending upon whether it is a clear film or a coloured arrangement to provide the band of colour. As shown in FIG. 1, a significant portion of the exterior of the front flap 14 includes the Mylar film as with the exterior of the rear flap 12. Thus when the folder having the band of colour applied thereto is lying on a desk either right side up or upside down, the large band of colour designates clearly, the group of files to which it belongs. To ensure a sufficient width of colour band, for example with a four inch width of film, two and a half inches may be applied to one surface of the web stock, which constitutes the exterior of the front and rear panels, and one and a half inches to the remaining surface which constitutes the interior of the front and rear flaps. Such one and a half inch overlap is sufficient, as already explained with reference to FIG. 4, to cover the doubled over portion of the folder edge. Such difference in widths of the film as applied to each side of the folder stock is shown in FIG. 2 by the dotted line which signifies the width of the film applied to the other side of the stock. This extra width of film also serves to distribute forces exerted on the tab to a larger area of the panel and reduce the possibility of tearing of the tab from the folder.

Figure 9:
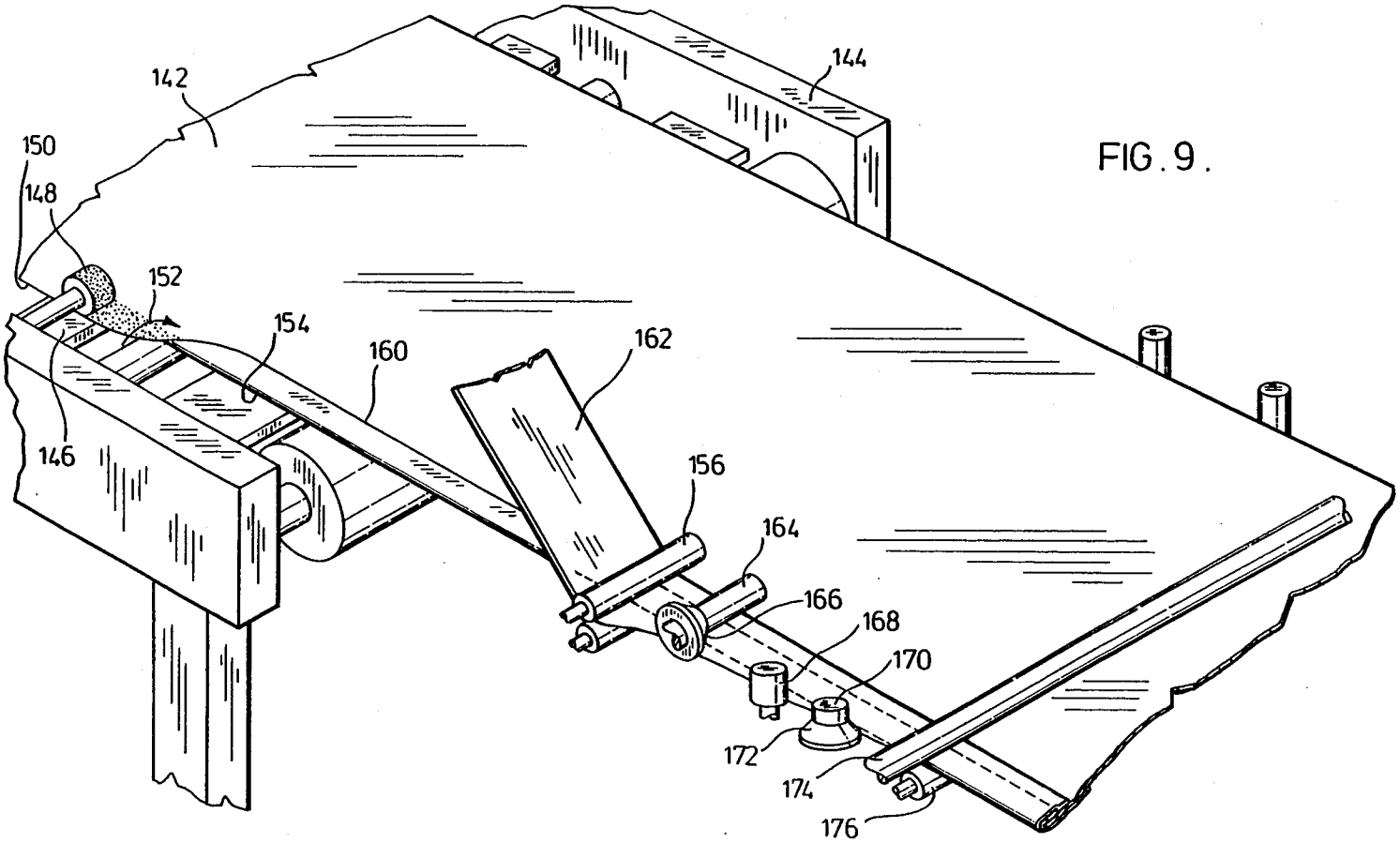
FIG. 9 is a perspective view showing the application of a film having fresh adhesive applied thereto.
Figure 10:
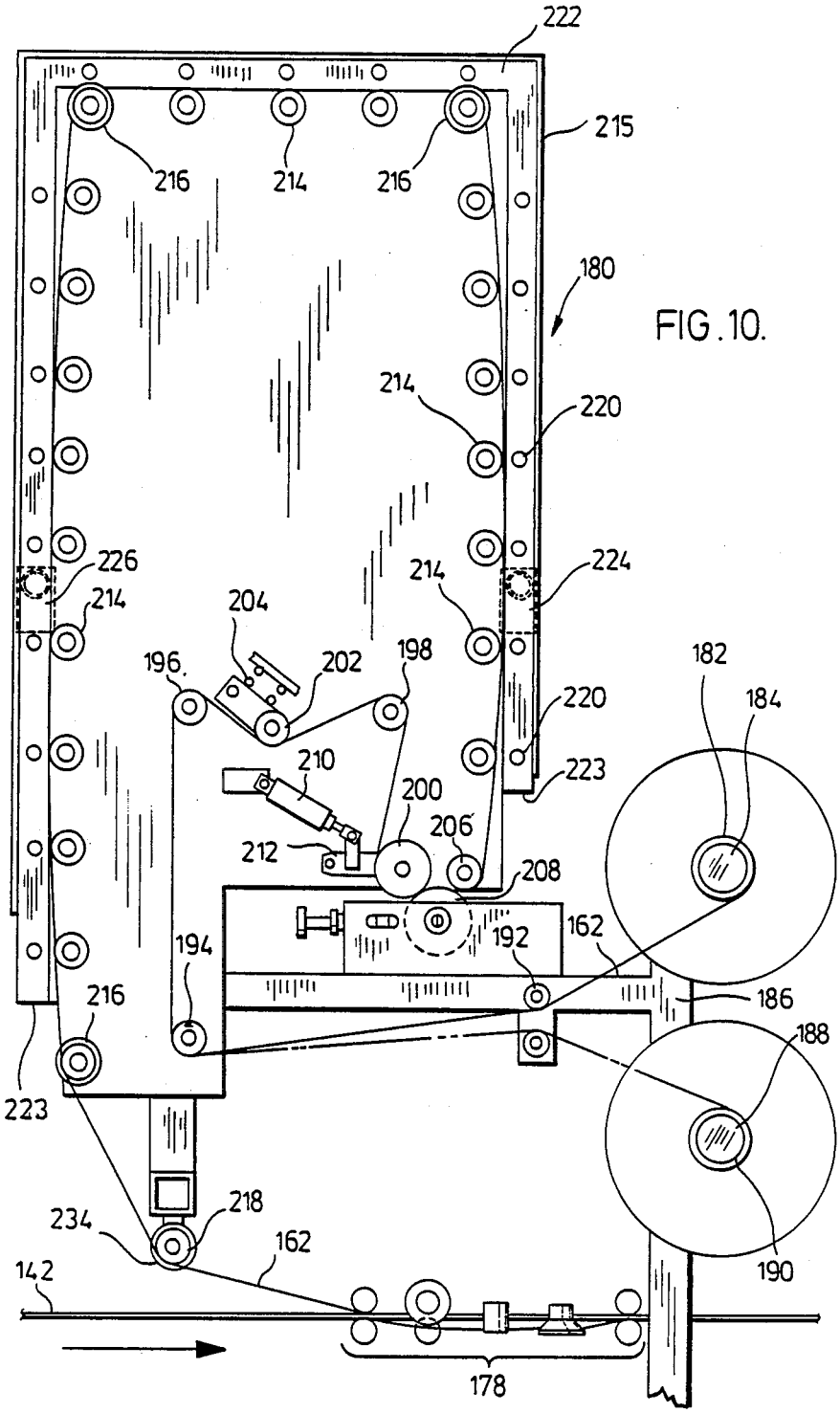
FIG. 10 is a side elevation of the machine for applying and drying adhesive on the film for application to folder stock web.

Referring to FIGS. 9 and 10 a machine is shown which allows the use of various coloured adhesives so that the folder side tab is of a desired colour. The adhesive applicator device of FIG. 10 supplies the transparent film which as shown in FIG. 9, moves in a downward slope and is secured onto a web which is conveyed to the machine. As with the device in FIG. 8 the web stock 142 is conveyed over framework 144 and over a support 146. A glue applicator roll 148 applies glue to an edge 150 of the web 142. A device (not shown) is used to plough over the edge 150 in the direction of arrow 152 and rollers are used to lay down and secure the folded over edge portion 154 of the web stock 142. The adhesive used is such that the folded over edge portion 154 remains flat after passing between spring loaded pressure rollers 156 and 158. The film is of sufficient width and secured to the web 142 in a manner so as to extend beyond edge 160 of the folded over portion 154 such that when the film 162 with pressure sensitive adhesive on its underside passes between the web edge 154 supported by roller 158 and the spring loaded roller 156, it is secured to the web edge and overlaps the edge 160 of the folded over portion of the web stock.

The film is then wrapped around and onto the undersurface of the web stock in a four-stage process. Having secured a portion of the width of the film 162 to the upper surface of the web stock, the accurate location of the film relative to the web stock is now determined. According to the example of a four inch width of film, one and a half inches of the film width is laid onto and secured to the presented surface of the folder stock. The next stage is to fold over the remaining two and a half inches of film which is commenced by roller 164 having bevelled face portion 166. Bevelled face 166 bends the film downwardly at an angle relative to the plane of the web stock. The next stage in bending the film is provided by vertical roller 168 which bends the film to a 90 degree angle relative to the plane of the web stock. The next stage of the fold over is provided by roller 170 having bevelled face 172 which begins to fold the film underneath the web stock at an acute angle relative to the underside of the plane of the web stock. The film, as bent under the web stock, can now be passed through spring loaded pressure rollers 174 and 176 to complete the securement of the folded over film to the web stock. The overall length of the roller arrangement 178 is sufficient to ensure a smooth wrap around the film without creases therein. The web stock is now ready for the next stage in manufacture, namely the die cutting thereof to provide the desired folder side shape and cut the folder blank from the web stock in a manner which is commonly used in the art. In instances where a clear film is applied to the web stock, a narrower film width may be used because of the nonrequirement of a large colour band. A three inch clear film may be used where the film is folded over equally on both surfaces of the web stock to reinforce the edge.

Turning to FIG. 10, the relative location of the roller arrangement 178 for applying the film 162 to the web is shown. Above the roller location is the apparatus 180 for withdrawing film from a supply roll, applying adhesive thereto and drying the adhesive preparatory to application of the film to the web stock 142 by the roller arrangement 178. The film 162 is withdrawn from a supply roll 182 which is supported on a spindle 184 which in turn is secured to a mainframe 186. The second spindle 188 is provided to carry a second supply roll 190 so as to be spliced with the film 162 when it is completely withdrawn from the first supply roll 182. The spindles 184 and 188 are adjustable laterally to accommodate various sizes of film width for use on the machine. The film 162 passes under roller 192 and over the remaining several rollers which serve to pass the film through the machine in applying and drying adhesive thereon. Rollers 194, 196 and 198 provide a path for the film so as to move vertically downwardly onto roller 200. To provide a predetermined tension in the film 162 sufficient to maintain the film without creases, a spring loaded roller 202 is provided as urged downwardly by spring 204. Roller 206 operates in conjunction with roller 200 to pass the film over adhesive application roller 208 which picks up adhesive from an adhesive tray to be described in more detail with respect to FIG. 12.

A sensor is used to determine when the web movement is stopped such as a sensor on the rolls for moving the web (not shown) so that when they stop a pneumatic cylinder 210 is actuated to retract upwardly roller 200 about hinged arm 212 to move the film 162 away from the adhesive application roll 208 which continues to rotate and circulate adhesive in the tray. This prevents wearing of the film and build-up of adhesive on the film during line shutdown.

As the film passes over the roller 208 a thin layer of adhesive is applied to the outer surface of the film 162. Thus the remaining series of rollers 214 and corner guide rollers 216 pass the web upwardly, across and downwardly to a final bottom guide roller 218.

The adhesive which is applied to the film may be of the water base type which is an emulsion of pressure sensitive adhesive solids in water. The layer of pressure sensitive adhesive on the film must be dried so there is little moisture left in the layer when applied to the folder to ensure a good bond with the folder material. To ensure that the adhesive is relatively dry, considering that the film may be moving at speeds in the range of 150 to 200 feet per minute, hot air is directed onto the adhesive through tubes 220 about the perimeter of U-shaped plenum 222 which carries hot air from hot air blowers shown in dotted at 224 and 226.

Figure 11:
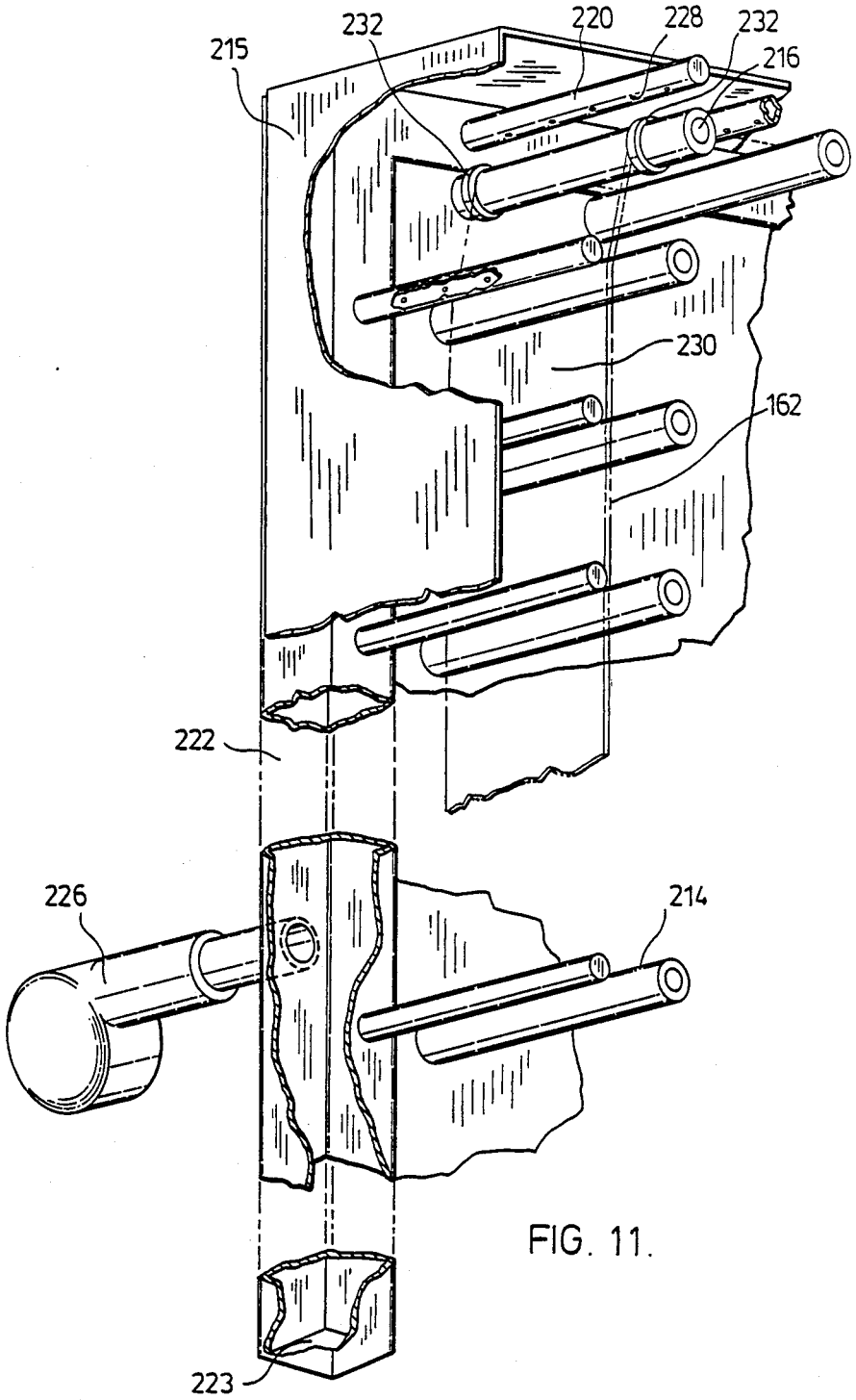
FIG. 11 is a partial view of the apparatus of FIG. 10 showing devices for drying the adhesive on the film.

The structure of the tubes 220 and the plenum 222 is shown in more detail in FIG. 11. A hot air blower 226 blows air into a hollow rectangular plenum tube 222 which is closed at its ends 223. The tubes 220 have a series of ports 228 which direct the hot air onto the surface 230 having the layer of adhesive on the film 162. The two hot air blowers 224 and 226 supply sufficient hot air through the ports 228 so that the adhesive is dried when it passes over exit roller 216 of the drying chamber arrangement. A shield 215 is provided about the perimeter of the U-shaped plenum 222. The shield extends slightly greater than the length of the rollers 214 to shield the film as it passes over such rollers from ambient air currents which may be laden with dust and other contaminants. To guide the path of the film through the drying chamber arrangement, each corner guide roll 216 has a pair of rings 232 as shown in FIG. 11 which are adjustable along the axis of the roller 216 so as to determine the lateral position of the film on these guide rollers and thereby direct the film about the perimeter of the U-shaped drying arrangement. Similarly, on roller 218 rings 234 are provided to locate the film 162 relative to the web stock 142 in properly positioning it for application to the file folder. Such ring in providing film position adjustment thereby accommodates various widths of film to be applied.

Figure 12:
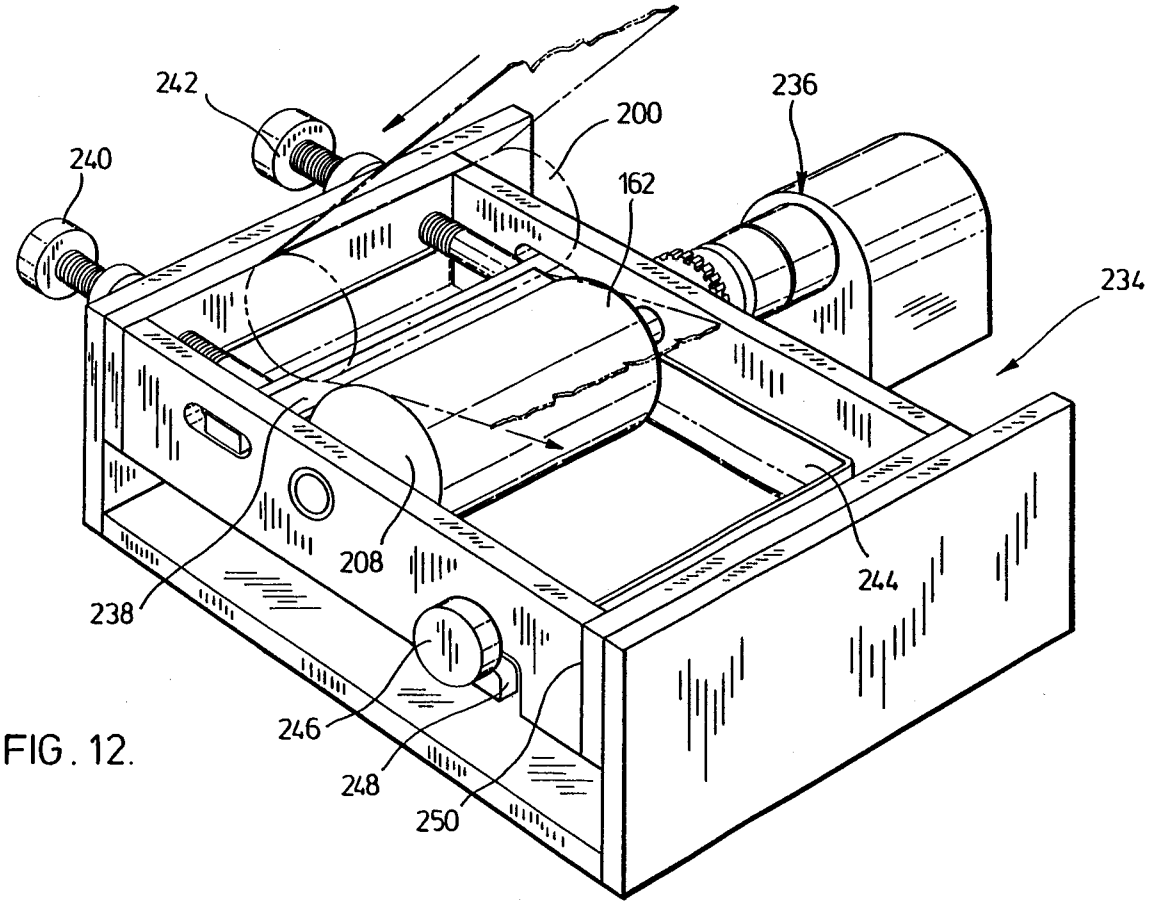
FIG. 12 is a perspective view of the device for applying a thin layer of adhesive to the film.

Turning to FIG. 12, the adhesive applicator device 234 comprises the driven roller 208 which applies a thin layer of adhesive to the film 162. The roller 208 is driven by a drive arrangement 236 which is synchronized with the speed at which the film passes through the apparatus 180 that is, the linear speed of the web stock 142. Thus, the roller 208 is rotated at a speed so as to have a peripheral linear velocity corresponding to the speed at which film 162 is moved through the apparatus 180. In synchronizing the speed of the drive 236 it will correspondingly vary the speed of the roller 208 depending on variations in the speed of the movement of the web stock 142.

A doctor blade 238 with caliber adjustments 240 and 242 determine the thickness of the adhesive layer picked up by the roller 208 from the adhesive tray 244. As mentioned, the drive 236 rotates at all times even during temporary stoppage of the line to circulate the adhesive in the tray 244. The tray 244 is removable from the adhesive applicator device 234 by loosening or knurled knob 246 which fits in inverted L-shaped slot 248. Upon loosening of the knob 246 tray may be moved forwardly and downwardly from the supportive framework 250 of the adhesive applicator device 234.

When it is desired to change colours of adhesive applied to the film 162, the adhesive tray 244 is removed and replaced with a different tray having a different coloured adhesive therein. When the tray is removed, access to roller 208 is gained to remove any remaining colour from the roller before applying the next coloured adhesive.

Since the adhesive is a water based type, the sensor which retracts roller 200 so that there is not a build-up of adhesive on the film 162 during line shutdown can also be used to turn off blowers 224 and 226 so as to not overdry or deteriorate the adhesive applied to the film. Therefore the line may be shutdown safely without damaging the adhesive applied to the film. On start-up the hot air blowers are reactuated to direct hot air onto the film to complete any necessary drying and continue to dry fresh adhesive as applied to the film emerging from roller 206 of the system.

The apparatus according to this invention is therefore useful in selectively applying a predetermined coloured adhesive to the film 162 before application to a folder. This provides the significant advantages of not only reinforcing the folder edge but also providing a desired coloured band along the folder edge to designate a group of folders in a file system having many different groups. A further advantage in using a coloured adhesive or a coloured film is the colour fastness of the band on the folder. Unlike coloured paper stock which will fade in sunlight, the colour band as provided by this invention does not fade. In addition, the control or the colour is more consistent because of the accuracy enabled in either colouring the film or the adhesive compared to a batch-to-batch process in making colour paper stock.

A further consideration in providing the coloured ban is to have coloured paper on the web stock edge and covered by the Mylar film. The colour of the paper shows through the clear film to provide a desired colour band. The colour paper may be secured to the Mylar film and the paper, in turn, be secured to the folder edge or conversely, the coloured paper may be secured to the folder edge and the Mylar applied over the coloured paper.

The plastic reinforcing film must, when applied to the paper web stock, reduce the tendency of the tab or edge to be torn from the paper web stock and distribute forces such that creasing and folding of the tab or panel adjacent the tab are reduced. Films which are suitable include, polythelene terephthalate films such as sold by Dupont under the trade mark Mylar, "Celanar" (trade mark) from Celanese and "Scotchpar" (trade mark) from 3M.

Figure 13A:
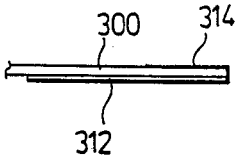
FIGS. 13*a*, 13*b* and 13*c* are a series of partial sectional views through the edge of a file folder diagrammatically illustrating several manufacturing steps.
Figure 13B:
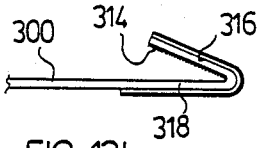
Figure 13C:
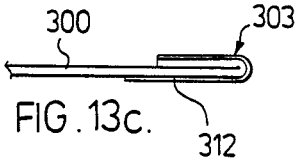
Figure 14:
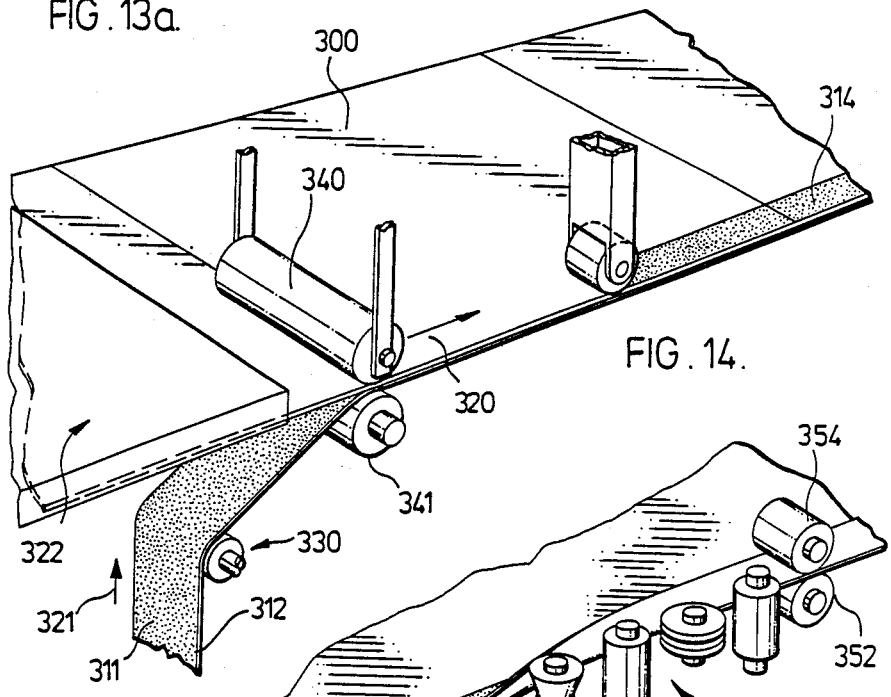
FIG. 14 is a partial perspective view showing an alternate method of applying the film to the paper web stock.
Figure 15:
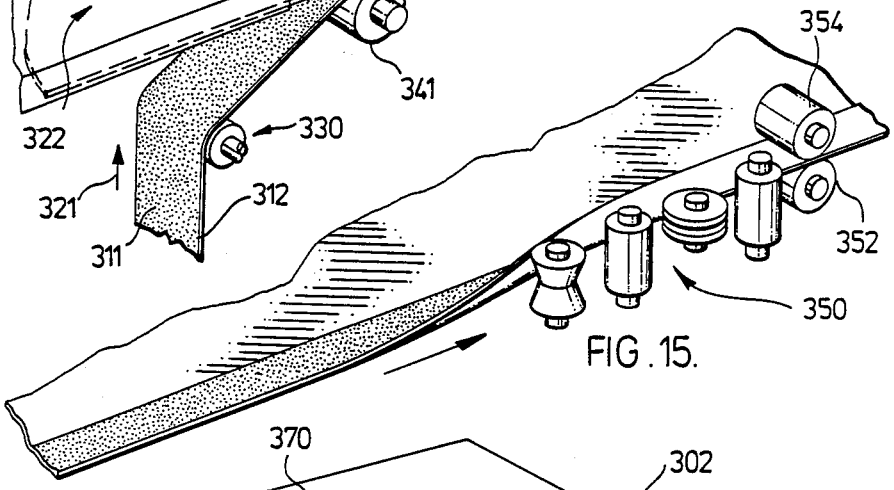
FIG. 15 is a partial perspective view of the web stock and film being folded upon itself after application of an adhesive to the opposite face of the web stock relative to the surface carrying the high tensile strength film.
Figure 16:
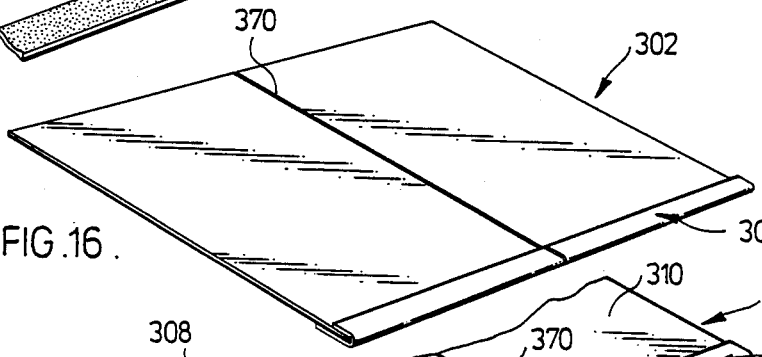
FIG. 16 is a perspective view of a folder blank with the plastic film secured about the reinforced edge.
Figure 17:
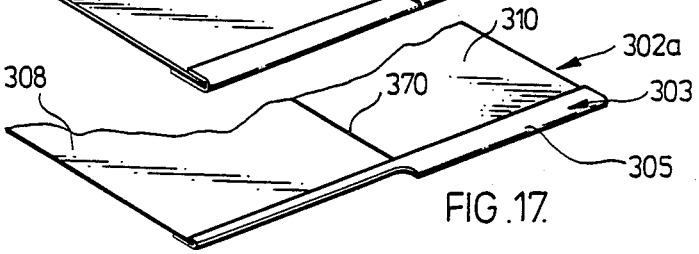
FIG. 17 is a partial perspective view of a folder blank similar to FIG. 16 having a portion of the reinforced edge removed to define a label securing portion on the remaining reinforced edge.

FIGS. 13 through 19 illustrate a variation of the method of manufacturing the product as well as a variation of the apparatus. For this reason, a new numbering scheme will be used. Referring to FIGS. 13, 14 and 15 the web 300 of paper web stock is advanced from a roll not shown and undergoes a number of operations to produce the file folder blank 302 shown in FIG. 16 or the modified folder blank 302*a* shown in FIG. 17. The difference between the folder blank of FIG. 16 and that of FIG. 17 is that a portion of the reinforced edge has been removed from the front panel 308 to thereby define an outward extension portion 305 on the front panel 310. As in the earlier figures the reinforced edge 303 has a high tensile strength reinforcing film 312 secured about the straight reinforced edge 303 with a portion of the film extending beyond the reinforced edge to be in direct contact with the portion of the web stock 300 adjacent the reinforced edge. In this way, reinforcement of the file folder adjacent the junction of the reinforced edge 303 and the abutting paper stock is achieved. This serves to distribute localized forces exerted on the outward extension 305 to the file folder and thereby avoid localized deterioration of the extension.

In FIG. 13 the high tensile strength film 312 has been adhesively secured in this case to the lower surface of the paper web stock as generally shown in FIG. 14 and an adhesive 314 has been applied to the opposite surface of the paper web stock for adhesively securing the paper web stock which will be folded upon itself. Therefore the paper web stock with the film on the lower surface thereof is folded upon itself to produce a reinforced edge portion with the high tensile film secured along the length either side of the reinforced edge and about the edge thereof. This defines two opposed surfaces of paper web stock indicated as 316 and 318 which are secured by adhesive 314 to provide a double thickness of paper web stock adjacent the edge of the file folder. It should be noted that the paper web stock and film are not folded in the center line of the film as it is preferable to have the film extend across the junction of the reinforced edge and the paper web stock to reinforce this and reduce the tendency of this reinforced area to be torn from the remaining body of the web stock.

Application of the high tensile film to the lower surface of the paper web stock and the subsequent folding of the film and paper web stock is shown in FIGS. 14 and 15. The high tensile strength film 312 is secured by an adhesive 311 to one surface of the paper web stock 300 adjacent the edge thereof, in this case to the lower surface of the paper web stock, as the web stock is advanced. This advancement is generally indicated by arrow 320 showing movement of the paper web stock and arrow 321 showing movement of the high tensile strength film with adhesive applied thereto. A paper web stock aligning device 322 accurately maintains alignment of the paper web stock as it is being withdrawn from the supply roll. One such aligning device is manufactured by G. W. D. Controls Limited and is referred to as a paper stock guide. This apparatus accurately maintains the edge of the paper web stock and therefore a manual aligning roller generally shown as 330 in FIG. 14 can be used to align the high tensile strength film with the edge of the paper web stock to assure placement of the film adjacent the edge of the web stock. Further details of the alignment roller 330 can be appreciated from a review of FIG. 19.

The high tensile strength film 312 is applied to the lower surface of the web stock 300 and is retained on the web stock as it is passed between pressure rollers 340 and 341. This assures the pressure sensitive adhesive 311 firmly bonds the high tensile strength film to the lower surface of the paper web stock. In applying the high tensile strength film, it is important to control the tension thereof to assure the film is not highly prestressed as it is applied to the paper web stock. It is preferred to merely apply sufficient tension to maintain the film flat as further stressing of the film will occur when the folder blank is folded to form front and back panels. Prestressing of the film can cause buckling of the paper stock. In contrast to the earlier apparatus, the high tensile strenth film is not driven but merely advanced by the web stock.

A further adhesive 314 is then applied adjacent the edge of the paper web stock and is used to secure the paper web stock portions 316 and 318 as shown in FIG. 13. After the adhesive 314 has been applied, the web stock is passed through a number of folding rollers generally designated as 350 to fold the paper web stock upon itself and subsequently pass the folded web stock through pressure rollers 352 and 354 in order to strongly adhere the paper web stock portions 316 and 318.

After completing the folding of the paper web stock with the film on the exterior surface thereof, the paper web stock is passed through a number of cutting or blanking operations to form folder blanks generally as shown in FIG. 16 and FIG. 17. In the embodiment shown, a fold line 370 has been produce on the folder blank 302 and 302*a* to thereby define front and back panels of the file folder. By removing a portion of the reinforced edge 303 as shown in FIG. 17, a file folder having a laterally extending portion 305 is produced suitable for use in lateral filing. However it can be readily appreciated that the fold line 370 could have been formed in a direction perpendicular to that shown to form a top readable system and therefore the present method and apparatus is not limited to file folders for use in lateral filing systems.

Figure 18:
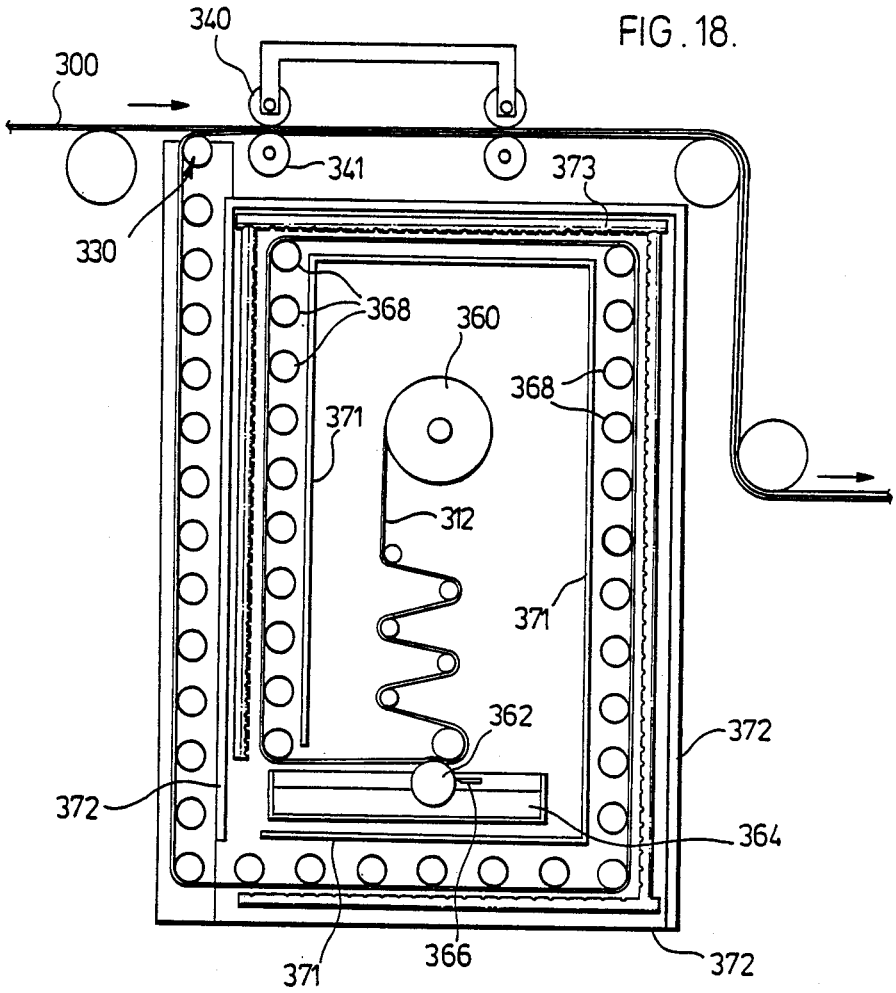
FIG. 18 is a section through a modified apparatus for applying adhesive to the lower surface to the high tensile strength film and subsequent drying of the film prior to securement of the film to one surface of the paper web stock.

FIG. 18 shows a modified apparatus for advancing the high tensile strength film passed an adhesive applying roller which applies a thin film of pressure sensitive adhesive emulsion to one surface of the film and subsequently dries the applied emulsion sufficiently to strongly adhere the film to the paper web stock. The apparatus includes a supply 360 of high tensile strength film, with the film 312 being threaded through a number of roller prior to contact with adhesive applying roller 362. This roller is partially submerged in a tank of pressure sensitive adhesive emulsion 364 which can be of a particular colour to colour code the edge of a file folder as previously described. The doctor blade 366 is above the level of emulsion and can be adjusted to accurately vary the amount of adhesive applied to the lower surface of a high tensile strength film. After the adhesive emulsion has been applied, the film is passed over a number of guides or rollers 368 which are contained within the heated channel plenum generally defined by wall members 371 and 372. Within this channel plenum a heat distribution conduit generally designated as 373 is provided which allows hot air to be circulated about the film to which the adhesive has been applied. The film after the adhesive has been dried is brought into contact with the lower surface of the paper stock 300 adjacent the two pressure rollers 340 and 341.

Figure 19:
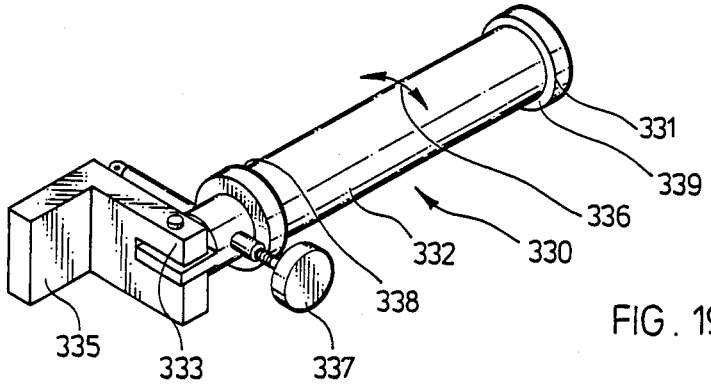
FIG. 19 is a perspective showing a roller used to align the film with the previously aligned paper web stock.

The alignment roller generally indicated as 330 is shown in greater detail FIG. 19. The free end of the roller generally indicated as 331 is the portion visible in FIG. 18. This alignment roller includes a rotatable barrel portion 332 secured by a pivot connection 333 to the support bracket 335. Thus the barrel 332 is freely rotatable and the axis of the barrel can be moved in the direction of arrow 336 by adjusting of the set screw 337. The high tensile strengh film is snuggly retained between the shoulders 338 and 339 whereby adjusting of the barrel can vary the position of the film relative to the paper web stock. As previously mentioned, the paper web stock is accurately aligned and therefore the simple manual adjustment of the alignment roller 339 is sufficient to accurately place the high tensile strength film adjacent the edge of the paper web stock.

It has been found that the product method and apparatus as described with respect to FIGS. 13 through 19 is preferred. Because the high tensile strength film is very thin, it is much easier to handle when secured on the paper web stock and problems such as creasing or folding of the film during application to the paper web stock are reduced.

Paper web stock is very susceptable to wear and separation of the individual layers thereof which substantially weakens the overall strength of the web stock. This problem is particularly acute at areas of high stress which are subject to damage such as the portion of the file folder which extends beyond the panels of the folder to present a surface to which labels can be applied for identifying of the file folder. As such, the label identifying portion is prone to wear and often will tear from the body of the folder. By applying a high tensile strength film either side of the paper substrate, and in a manner to bridge the transition between the reinforced edge and the body of the file folder, the tendency of the paper stock to separate is reduced as the high tensile strength film reinforces the area and limits the separation of the individual layers. By providing a film of substantially greater width than the label extending portion and securing the film in a manner such that the film is secured to the web stock interior to the label extending portion a distance approximately at least equal to the label extending portion, it has been found that the tendency of the edge of the panel to tear from the folder is reduced as the high tensile strength film provides a means for distributing the force, which is locally applied to the label extending portion, to a larger area of the file folder. Therefore edges of file folders prone to damage can be reinforced in the manner described to significantly increase the effective life of the file folder or substrate.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A file folder comprising a paper substrate having front and back panels joined along a fold line with said panels cooperating to define an integral side tab along at least a side edge of said back panel exposed beyond a corresponding side edge of the front panel when said file folder is in a folded condition, said side tab being connected with said corresponding side edge of said front panel by an undercut region, a high tensile strength reinforcing flexible plastic film adhered to each side of said undercut region and to each side of said side tab and to each side of said front panel at said corresponding side edge and reinforcingly bridging across said fold line on each side thereof, said film and paper stock along said corresponding side edge and said undercut region terminating at a commonly cut edge where said film and said paper substrate cooperate to increase the tear resistance of the folder at said commonly cut edge.

2. A file folder as claimed in claim 1 wherein said undercut region is provided on said front panel immediately adjacent said fold line and in a manner to provide a curved edge between said side tab and said front panel.

3. A file folder as claimed in claim 2 wherein said film secured to said tab is of a total width of about 3 to 4 inches with at least one and a half inches applied to opposed sides of said tab.

4. A file folder as claimed in claim 2 wherein said side tab and said front panel adjacent said side edge are of a double thickness of said paper substrate.

5. A file folder as claimed in claim 1 including at least one pressure sensitive adhesive label carried directly on the surface of said film and located on said side tab.

6. A lateral file folder made of a suitable paper stock and comprising front and back panels joined by a fold line, each panel having a corresponding reinforced side edge region joined in the length thereof by a transition region, said reinforced side edge regions and said transition region being of a double thickness of adhered paper stock and of a shape to produce a side labelling extension along essentially the length of the side edge region of said back panel exposed beyond the side edge region of said front panel when said folder is folded, said file folder including a flexible plastic reinforcing film adhered on each side of said edge regions and said transition region along the entire length thereof and reinforcingly bridging said fold line on opposite sides thereof, said film and paper substrate at said side region of front panel and said transition region co-terminating at a common cut edge.

7. A lateral file folder as claimed in claim 6 wherein said transition region includes a continuous curved edge which joins the edge of said labelling extension and the side edge region of said front panel both of which are essentially straight.

8. A lateral file folder as claimed in claim 7 wherein said transition region is located to one side of said fold line.

9. A lateral file folder as claimed in claim 7 wherein said transition region is at said fold line joining said front and back panels.

10. A file folder as claimed in claim 9 wherein said film is of a color different than said paper stock to provide a color band along an edge of the folder.

11. A lateral file folder as claimed in claim 6 wherein said extension includes adhesively secured labels thereon directly carried by said film.

12. A file folder of paper stock having a body portion folded to form a generally rectangular front panel and a generally rectangular back panel, one of said panels having an integral identification extension along one edge thereof, said extension having a high tensile strength plastic film adhesively secured to either side and extending the length of said extension, and wherein said file folder is a lateral file folder having said extension along a side edge thereof, said plastic film extending about the edge of said extension and extending and secured to either side of said other panel at the edge adjacent said extension to reinforce said file folder at said extension and a fold line in said body portion between said front and back panels.

13. A file folder as claimed in claim 12, including at least one label secured to said film on each side of said extension.

* * * * *